US006220190B1

(12) United States Patent
Dumbaugh et al.

(10) Patent No.: US 6,220,190 B1
(45) Date of Patent: Apr. 24, 2001

(54) WATER-COOLED OSCILLATING GRATE SYSTEM

(76) Inventors: George David Dumbaugh, 1500 Sylvan Ct., Louisville, KY (US) 40205; Kevin M. Toupin, 35 Hubbardston Rd., Princeton, MA (US) 01541

( * ) Notice: Subject to any disclaimer, the term of this patent is extended or adjusted under 35 U.S.C. 154(b) by 0 days.

(21) Appl. No.: 09/232,090

(22) Filed: Jan. 15, 1999

(51) Int. Cl.[7] ..... F23H 17/08; F23H 3/02

(52) U.S. Cl. ..... 110/328; 110/300; 110/286; 110/268; 110/185; 122/376; 126/152 B; 126/163 R; 126/169

(58) Field of Search ..... 110/185, 186, 110/267, 268, 278, 280, 286, 298, 299, 300, 327, 328; 432/121, 239; 122/376; 126/152 B, 152 R, 163 A, 163 R, 167, 169

(56) References Cited

U.S. PATENT DOCUMENTS 1,939,177 * 12/1933 Losch ..... 126/169
2,583,433 * 1/1952 Losch ..... 126/152 R X
3,005,446 * 10/1961 Kock ..... 122/376

(List continued on next page.)

FOREIGN PATENT DOCUMENTS

143465 * 8/1980 (DD) ..... 126/152 B

OTHER PUBLICATIONS

A Bulletin by Detroit Stoker Company, entitled "Detroit Hydrograte, Water Cooled, Continuous Ash Discharge Spreader Stoker", Bulletin No. 1501, pp. 1–4. (undated).

A single–page of a Detroit Hydrograte Bulletin by Detroit Stoker Company, entitled "Detroit Hydrograte–An advanced design spreader stoker with water–cooled, vibrating, continuous ash discharge grates". (undated).

Page 5 of Kinergy Bulletin KDC–1, entitled "Kinergy Driven Vibrating Conveyors", Oct., 1997.

Page 6 of Kinergy Bulletin KDB–1, entitled "Moving and Processing Bulk Solids by the Kinergy Drive System", Jan., 1992.

*Primary Examiner*—Ira S. Lazarus
*Assistant Examiner*—Ljiljana V. Ciric
(74) *Attorney, Agent, or Firm*—Mason, Kolehmainen, Rathburn & Wyss

(57) ABSTRACT

An integral water-cooled, air permeated, vibrating grate system for combusting biomass and other fuels in a boiler includes a grate top surface having air-flow apertures extending therethrough. The grate top surface is supported by a plurality of water-cooling pipes which arc coupled to a water supply. An enclosed air plenum unit is positioned under and attached directly to the grate top surface. The air plenum unit is coupled to an air supply for providing combustion air through the top grate surface air-flow apertures. The air plenum unit includes multiple zones, each of which zones has an associated air flow control damper so that the flow of combustion air can be controlled. Ash siftings formed on the grate top surface when the biomass or other fuel is combusted fall into the air plenum unit and flow toward at least one ash-siftings discharge opening at a discharge end of the air plenum when the grate top surface and the air plenum is vibrated. The grate top surface and the air plenum are vibrated together by a vibratory drive-isolation assembly which includes a longitudinally extending counterbalance member. A plurality of drive springs are supported by the counterbalance member. The drive springs are distributed across the width and the length of the top grate surface and at least one vibratory motor or mechanism is associated with the counterbalance member so that the vibration can be adjustably controlled.

28 Claims, 8 Drawing Sheets

U.S. PATENT DOCUMENTS

| | | | | |
|---|---|---|---|---|
| 3,126,846 | | 3/1964 | Wagner . | |
| 3,251,457 | | 5/1966 | Dumbaugh . | |
| 3,395,655 | | 8/1968 | Guy . | |
| 4,250,818 | * | 2/1981 | Sigg | 110/278 |
| 4,287,056 | | 9/1981 | Dumbaugh et al. . | |
| 4,326,469 | | 4/1982 | Reschly . | |
| 4,389,978 | | 6/1983 | Northcote . | |
| 4,437,452 | | 3/1984 | Reschly . | |
| 4,492,629 | | 1/1985 | Dumbaugh . | |
| 4,576,101 | | 3/1986 | Reschly . | |
| 4,633,849 | | 1/1987 | Knox . | |
| 4,774,893 | | 10/1988 | Dumbaugh . | |
| 4,844,289 | | 7/1989 | Dumbaugh . | |
| 4,899,669 | | 2/1990 | Dumbaugh . | |
| 4,936,231 | | 6/1990 | Johnson . | |
| 4,960,229 | | 10/1990 | Dumbaugh . | |
| 4,987,837 | | 1/1991 | Reschly et al. . | |
| 5,046,643 | | 9/1991 | Dumbaugh . | |
| 5,265,543 | | 11/1993 | Hamaker et al. . | |
| 5,361,892 | | 11/1994 | Hamaker et al. . | |

* cited by examiner

WATER-COOLED OSCILLATING GRATE SYSTEM

FIELD OF THE INVENTION

The present invention generally relates to boiler systems, and more particularly, relates to a water-cooled oscillating grate system for a boiler, for example, used with biomass fuels.

DESCRIPTION OF THE RELATED ART

Various vibrating grate boiler arrangements are known. For example, U.S. Pat. No. 4,389,978 issued Jun. 28, 1983, discloses a grate having a fuel supporting and conveying surface including a plurality of elongate longitudinally-oriented, generally V-shaped channels. Water cooling pipes are provided for base and top part of each channel. Air feed openings are provided between both sidewalls of each channel. The grate is vibrated by a motor located outwardly of the boiler shell.

U.S. Pat. No. 3,126,846 entitled INCINERATOR GRATE issued Mar. 31, 1964 discloses a grate including multiple, alternate stationary and movable grate members. The movable grate members are reciprocated relative to the stationary grate members from front to rear relative to the incinerator. Space below the grate is divided into multiple chambers that communicate with a forced air supply duct. The amount of air for combustion supplied to various sections of the grate is controlled by adjusting dampers.

U.S. Pat. No. 4,987,834 entitled SIFTINGS REMOVAL DEVICE discloses a furnace having an ash discharge system which collects and receives siftings falling from portions of an incinerator grate. The ash discharge system includes multiple hoppers disposed under a grate. Each hopper forms an air plenum for directing and controlling the flow of combustion air to the furnace.

U.S. Pat. No. 4,437,452 entitled ROTARY CONTINUOUS ASH DISCHARGE STOKER discloses a rotary continuous ash discharge stoker having a circular grate for supporting burning fuel. The circular grate includes a central stationary section and an outer rotating section or ring. The rotating ring is supported and guided on rails and rollers which allow for the complete rotation of the grate section. Pressurized air is supplied into the housing below the circular grate via a plurality of air plenums.

Effective air distribution is not easily accomplished in the many known vibrating grate systems. A need exists for an improved water-cooled vibrating grate system that facilitates efficient combustion by effective combustion air distribution.

In one known design only the air permeated water-cooled grate is vibrated. Flat bar type springs are used to support the grate. The drive consisting of a number of eccentric crank arms spread along the length of a shaft, is directly attached to the vibrating grate. Usually one crank arm for each section of grate is utilized. The common shaft i s powered by pulleys connected to an electric motor. The conveying speed of the ash on the water-cooled grate is essentially fixed and not easily electrically adjusted while it is in operation. This stoker grate design often causes excess vibration to the boiler and the surrounding structure.

Typically the vibrating grate is essentially pushed and pulled by the crank arm located at one end, its conveying stroke is not always equal or the same along its full length. Thus, the conveying of the ash over the surfaces of the grate is not uniform. A relatively large amount of input horsepower is required to drive this vibrating grate because the single input or brute force kind of drive used is not energy efficient. To compensate for the non-uniform ash movement, this kind of vibrating grate is usually declined downhill instead of being mounted horizontally. This added slope require s more vertical height. The grate sections are typically 6 feet wide sections, so that the needed full grate width dimension had to be made up in multiple sections. Steep walled hoppers are required underneath to collect the ash siftings that fall down through openings between the grate sections. The overall combination of this type of vibrating grate combined with the needed ash siftings collecting hoppers below required an excessive amount of headroom. Multiple water pipes are projected from each end of the grate to stationary water headers. This arrangement adds cost, causes excess vibration transmission, and prompts metal fatigue in the water pipes.

In many vibrating grate systems often excessive vibration is coupled to the boiler and the surrounding structure. This occurs, particularly when the grate is not effectively counter-balanced. A need exists to provide an improved water-cooled vibrating grate system that minimizes the vibration coupled to the boiler and the surrounding structure.

SUMMARY OF THE INVENTION

A principal object of the present invention is to provide an improved water-cooled, vibrating grate system. Other objects of the invention are to provide a water-cooled, vibrating grate system that provides effective, efficient and reliable operation, and that overcomes some disadvantages of prior art arrangements.

In brief, a water-cooled, vibrating grate system for a boiler for use with biomass and other fuels includes a grate unit having a top grate surface. The top grate surface includes air-flow apertures. A plurality of water-cooling pipes support the top grate surface. The plurality of water-cooling pipes are coupled to a water supply. An air plenum unit is positioned under and attached to the top grate surface. The air plenum unit is coupled to an air supply for providing combustion air through the top grate surface air-flow apertures. A vibration drive isolation assembly vibrates the grate unit.

In accordance with features of the invention, the vibration drive isolation assembly includes a longitudinally extending counterbalance member. A plurality of drive springs are supported by the counterbalance member. The drive springs are distributed across the width and the length of the enclosed grate unit. At least one vibratory motor or mechanism is installed on the counterbalance member. A plurality of isolation springs support the longitudinal counterbalance member.

In accordance with features of the invention, the air plenum unit includes multiple zones. Each zone has an associated air flow control damper for controllably providing combustion air flow. The air plenum unit receives grate ash siftings. Usually, a plurality of ash-siftings discharge openings are located at a defined discharge end of the air plenum unit. The ash siftings being directionally vibrated to the ash-siftings discharge openings. The air plenum unit is directly attached to the top grate surface to minimize under grate air leakage.

BRIEF DESCRIPTION OF THE DRAWING

The present invention together with the above and other objects and advantages may best be understood from the following detailed description of the preferred embodiments of the invention illustrated in the drawing, wherein.

DETAILED DESCRIPTION OF THE PREFERRED EMBODIMENTS

Figure 1:
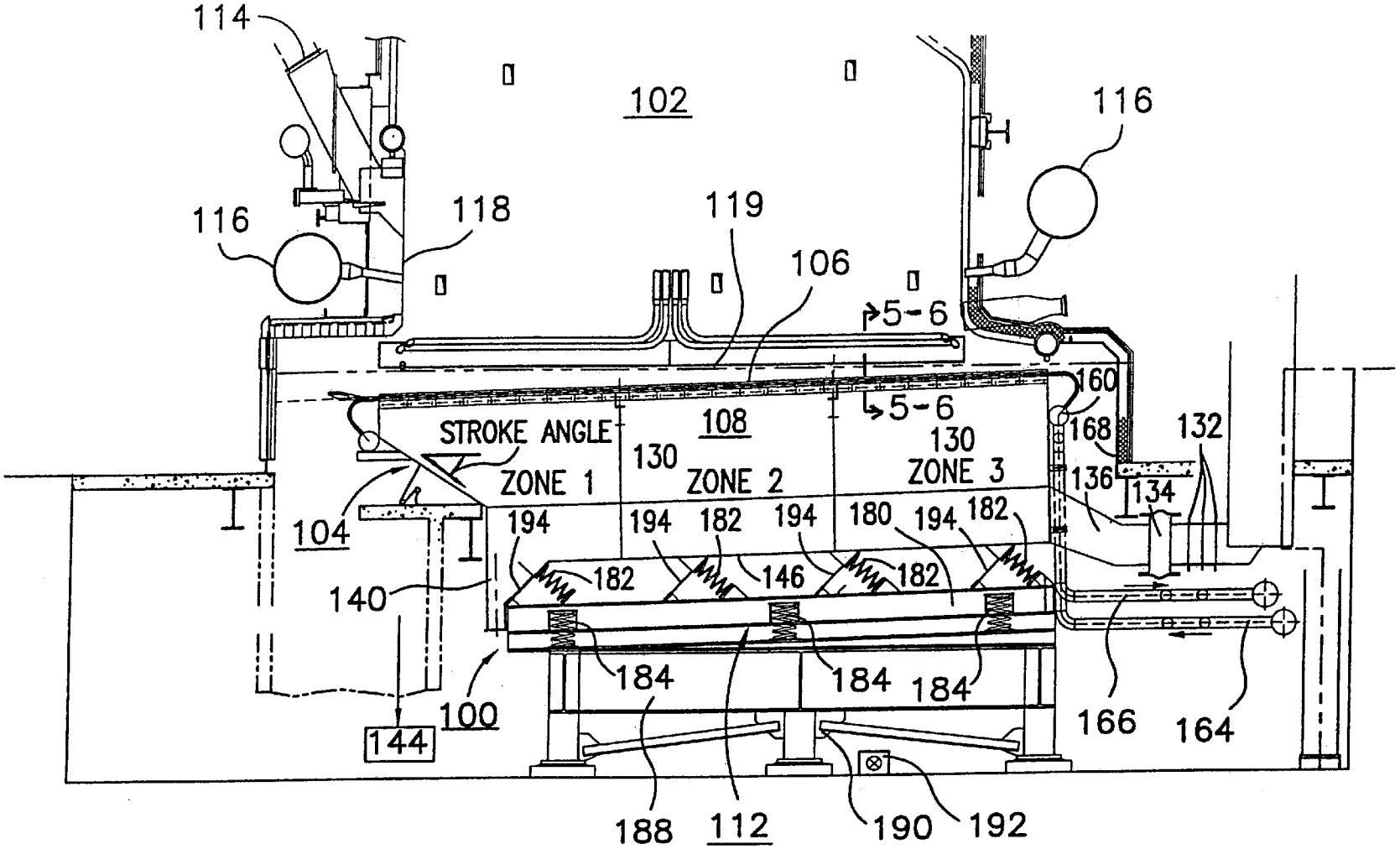
FIG. 1 is a fragmentary side elevational view of a boiler including a water-cooled, vibrating grate system arranged in accordance with the present invention.

Having reference now to the drawing, FIG. 1 illustrates a water-cooled, air permeated, vibrating grate system generally designated by reference character 100 and arranged in accordance with the present invention in a boiler 102. In accordance with features of the invention water-cooled oscillating grate system 100 includes a single grate unit generally designated 104. Among its primary components, grate unit 104 includes a top grate surface 106, an air plenum 108 and a plurality of water cooling tubes 110. Grate unit 104 is an enclosed and air permeated, integral unit. Water-cooled, vibrating grate system 100 has a vibration isolated drive system generally designated by 112 arranged in accordance with the present invention. As shown in FIG. 1, the boiler 102 includes a fuel inlet 114 to permit fuel, such as biomass fuel, to be fed downwardly onto the grate surface 106. Boiler includes multiple overfire air ports 116 for supplying overfire air within the boiler shell 118. It should be understood that the utility of the present invention is not restricted to a particular boiler or furnace arrangement.

In accordance with features of the invention, the water-cooled oscillating grate system 100 is arranged for firing biomass fuels, which vary in moisture content and heating value. Each fuel requires its own proportion of combustion air quantity, combustion air temperature, degree of oscillation, and speed of fuel travel on the grate. Water-cooled, vibrating grate system 100 allows the use of high temperature undergrate air for high moisture fuels, with grate components being protected from overheating. The constant flow of cooling water through pipes 110 is also sufficient protection for the grate surface 106 when firing the boiler with auxiliary fuel burners properly located above the grate surface 106. The grate surface 106 does not require a layer of insulating material for protection. To conserve heat and water, boiler feedwater (supply line 119 in FIG. 1) is generally used for grate cooling; however it should be understood that other water sources may also be used.

Figure 2:
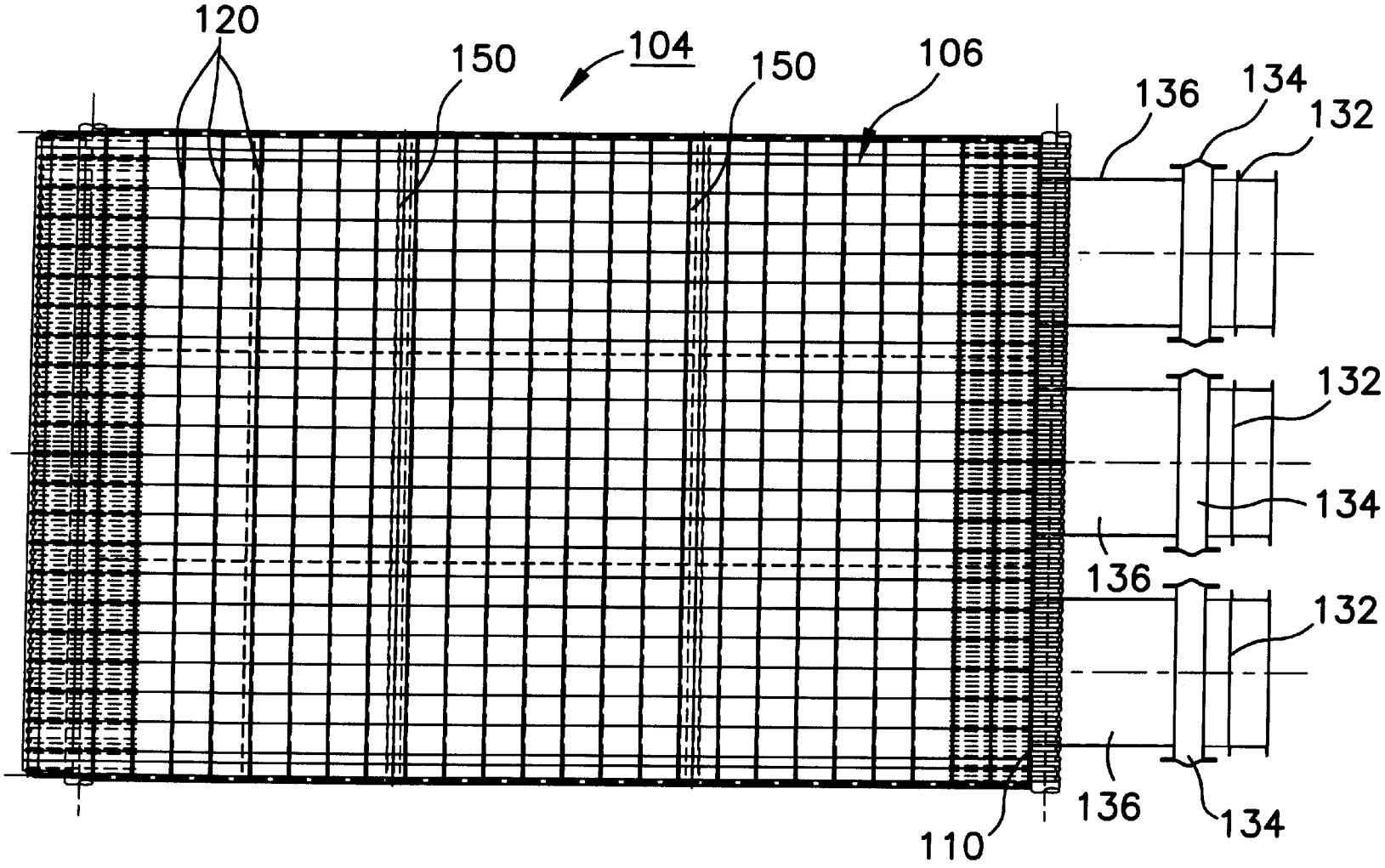
FIG. 2 is a top elevational view of the water-cooled oscillating grate assembly of FIG. 1 in accordance with the present invention.
Figure 2A:
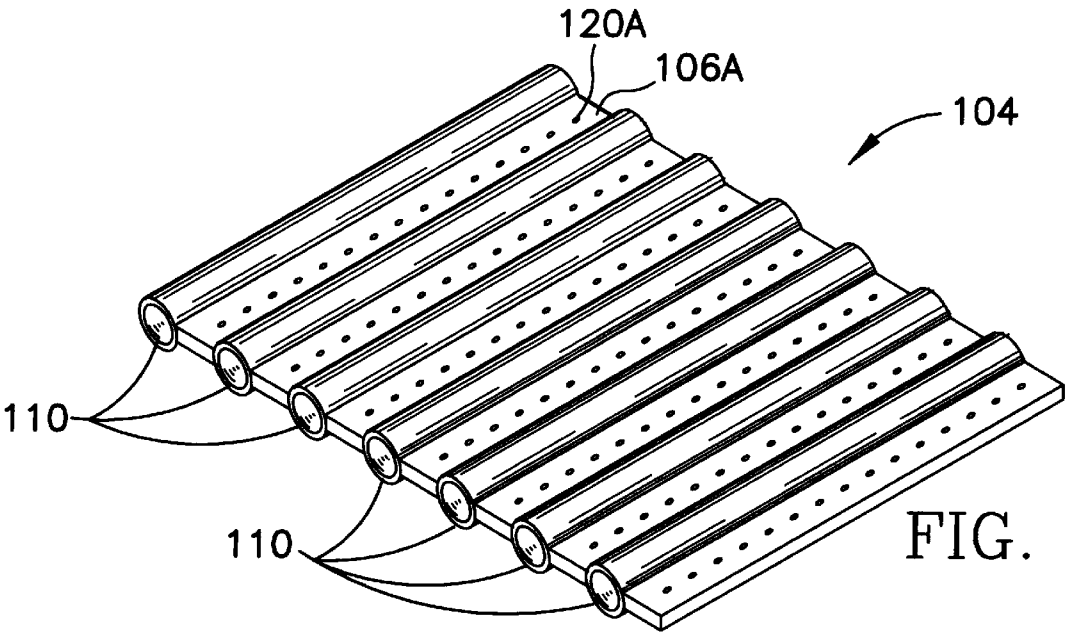
FIG. 2A is an isometric view of an alternative grate surface together with water cooling pipes of the water-cooled oscillating grate assembly of FIG. 1 in accordance with the present invention.

Referring also to FIGS. 2, 2A, 3, 4, 6A, 6B, and 6C, in accordance with features of the invention, the top grate surface 106 of grate unit 104 includes a plurality of air-receiving openings 120 for receiving combustion air from the air plenum 108. In FIG. 2A, there is shown an alternative, water jacketed air-permeation flat deck 106A forming the grate top surface of the grate unit 104. The flat deck 106A similarly includes a plurality of air-receiving openings 120A for receiving combustion air from the air plenum 108.

As can be seen in FIGS. 2, 6A, 6B, and 6C, the grate surface 106 is formed by a plurality of low-maintenance grate clips 122 made of high temperature cast material, seated on the water cooling tubes 110 with high conductivity grout. Grate clips 122 provide a high pressure drop grate surface 106 for better air distribution through the grate unit 104.

In accordance with features of the invention, air plenum unit 108 includes multiple air flow zones 130 beneath the grate surface 106 to allow for balancing the air flow across the front, middle and rear grate sections. Siftings fall down into the plenum 108 and are simultaneously conveyed to discharge openings 140 in the plenum 108 by directional vibratory motion provided by assembly 112.

Incoming air plenum 108 is installed directly under the water-cooled grate surface 106 and is an integral part of the unit 104. This plenum 108 receives the incoming air and properly distributes this air to predefined sections of the grate. The vibratory drive assembly 112 is located underneath the enclosed air plenum 108.

Figure 3:
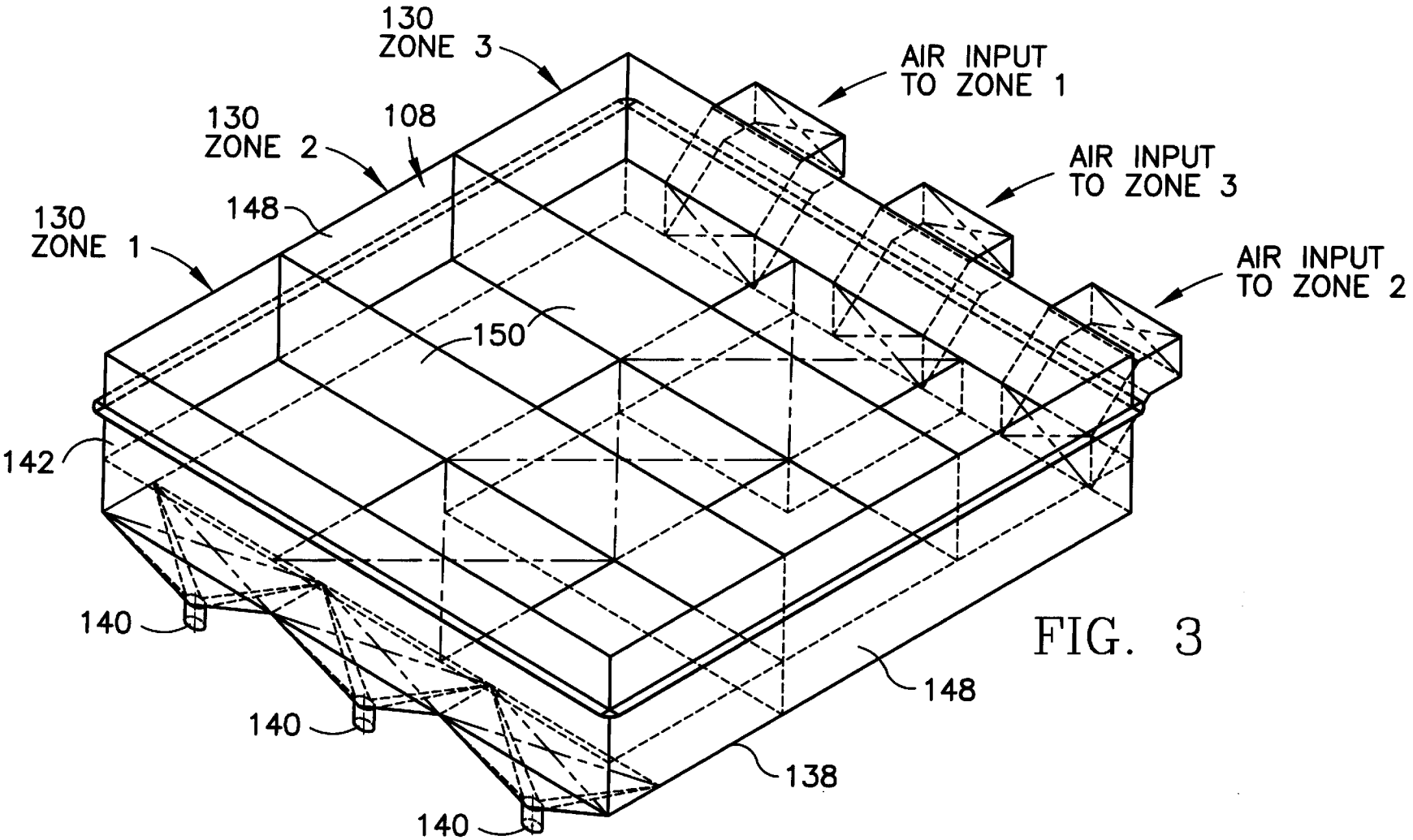
FIG. 3 is an isometric view of a plenum chamber of the water-cooled oscillating grate assembly of FIG. 1 in accordance with the present invention.
Figure 4:
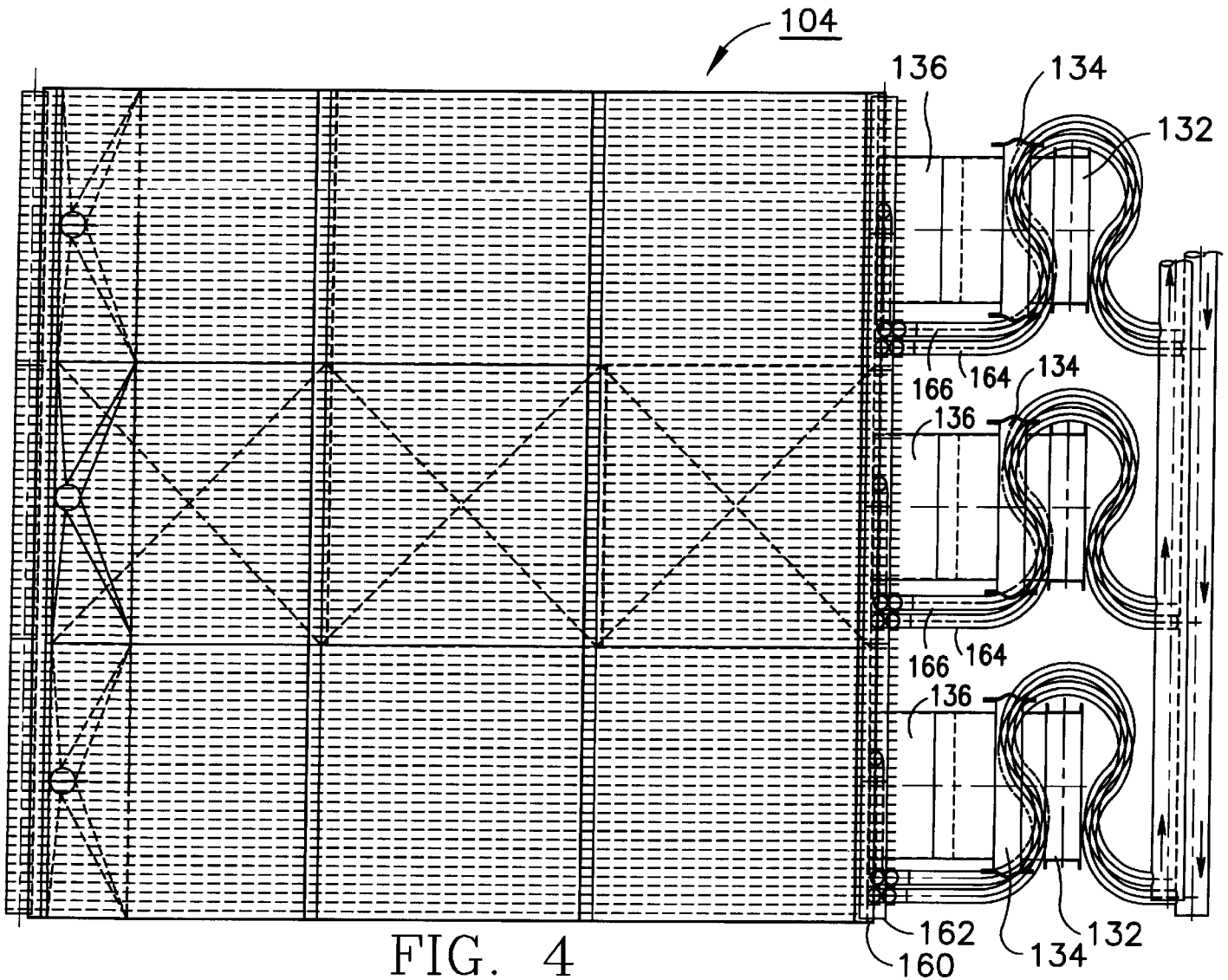
FIG. 4 is a top elevational view illustrating water-cooling components of the water-cooled oscillating grate assembly of FIG. 1 in accordance with the present invention.

As shown in FIGS. 1 and 3, the grate air flow is controlled to three air plenum zones 130 consisting of front, middle and rear zones labeled ZONE 1, ZONE 2 and ZONE 3 in FIGS. 1 and 3. Each zone 130 has an associated air flow control damper 132 located upstream of an expansion joint 134 in a respective zone air supply line 136. The result is air flow can be biasing to improve the air to fuel mixing. When needed, and in addition to the multiple zones, air distribution in either the longitudinal or transverse direction can be controlled with added sleeves constructed of tubular type perforated plate (not shown). A flat bottom conveying pan 138 forms the lower section of the air plenum 108. The bottom 138 of the air plenum 108 acts as an ash siftings collector for any passed particles being burned on top of the grate unit 104. By accomplishing this, the ash collecting hoppers previously utilized could be omitted or eliminated. The ash siftings are collected and simultaneously conveyed to the discharge end of the grate unit 104. The grate ash siftings to the air plenum 108 are directionally vibrated to a plurality of front siftings discharge openings 140 at a discharge end 142 of the air plenum unit 108. An air plenum ash siftings receiving hopper 144 can be cleaned on-line. Since the grate unit 104 carries the conveyed ash and the cooling water load, the lower enclosure portion of 146 of grate unit 104 must provide adequate structural strength to enable grate unit 104 to be driven by the vibratory drive configuration 112. The lower enclosure portion of 146 is a structural grid frame. Transverse and longitudinal structural beams supporting the frame 146 are connected to the vertical sidewalls 146 of the air plenum 108. The vertical walls 150 between the air plenum zones 130 are structurally reinforced with added columns appropriately spaced internally and externally.

The top ash conveying grate surface 106 is air permeated and water-cooled via multiple water cooling pipes 110. As shown in FIG. 1, top ash conveying grate surface 106 is installed generally horizontally. The top ash conveying grate surface 106 could be installed slightly declined or inclined, if preferred. A pair of water headers 160 and 162 are included as an integral part of the grate unit 104 and vibrate with unit 104.

Referring to FIG. 1, an inlet water header 160 and an outlet water header 162 installed on one end of the grate unit 104 are respectively connected to inlet and outlet water lines 164 and 166. Since the inlet header 160 and outlet water header 162 are an integral part of the grate unit 104, the headers 160 and 162 vibrate with the unit 104. The water lines 164 and 166 are flexibly connected to the two headers 160 and 162.

Figure 5A:
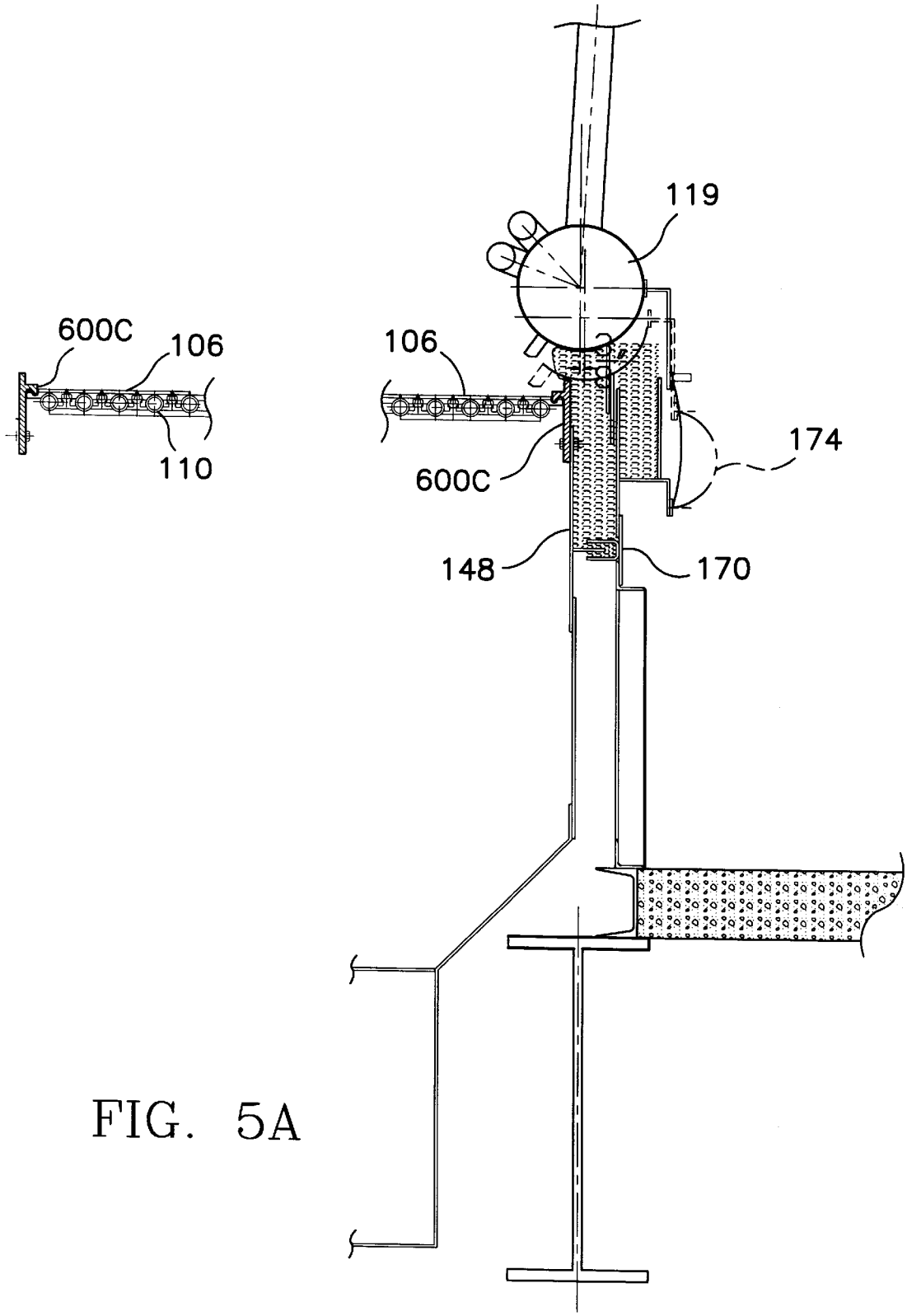
FIGS. 5A and 5B are side sectional views taken along line 5–6 of FIG. 1 illustrating a grate to boiler sealing arrangement of the water-cooled oscillating grate assembly of FIG. 1 in accordance with the present invention.
Figure 5B:
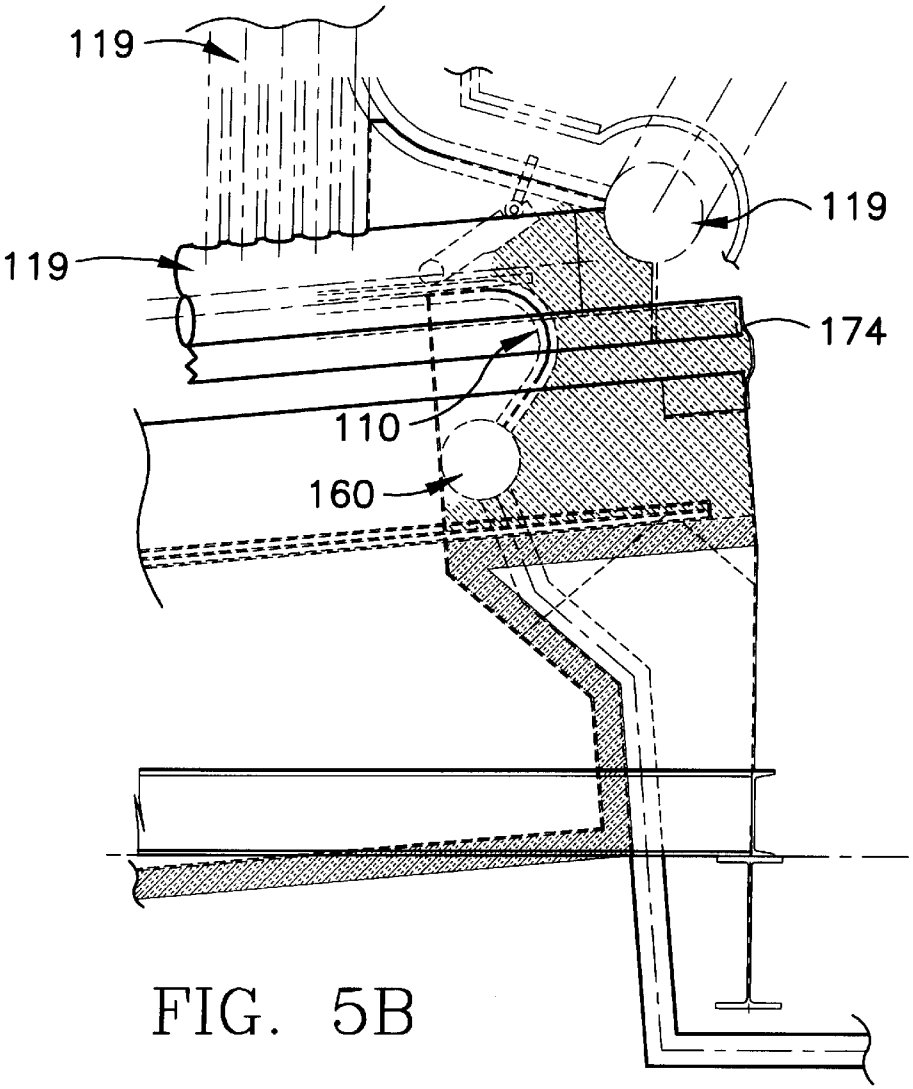

Referring to FIGS. 5A and 5B, where the water-cooled grate unit 104 engages the boiler shell 118, an appropriate flexible connection is provided. Perimeter sealing connections between the boiler 102 and grate unit 104 are provided by a labyrinth type seal 170 and a flexible fabric expansion joint connection 174 as shown in FIG. 5A and 5B. The perimeter bladed labyrinth type seal connection 170 is provided in-line with the vibratory stroke angle of the vibration drive isolation assembly 112. The perimeter flexible fabric expansion joint 174 provides sealing for the boiler 102 thermal expansion movement.

Figure 6A:
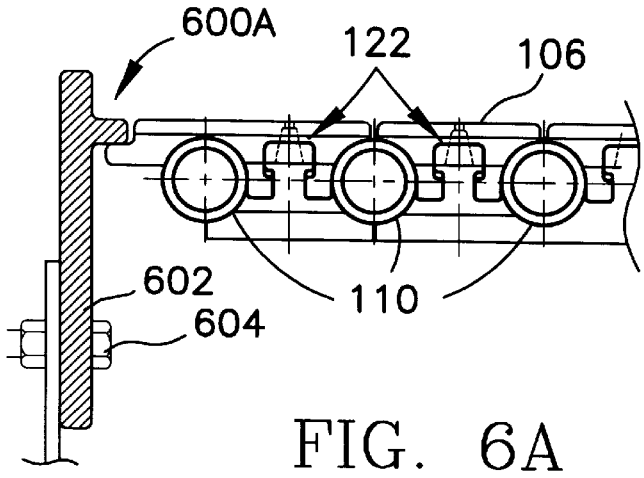
FIGS. 6A, 6B, and 6C are side sectional views taken along line 5–6 of FIG. 1 illustrating alternative sealing arrangements of the under grate air plenum chamber to the grate surface of the water-cooled oscillating grate assembly of FIG. 1 in accordance with the present invention.
Figure 6B:
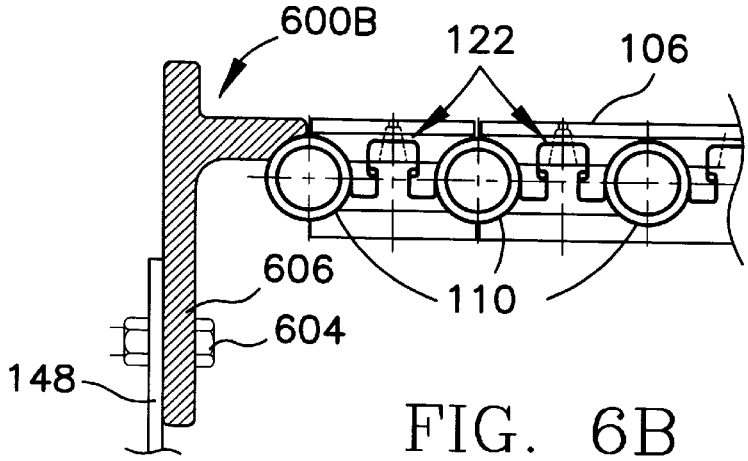
Figure 6C:
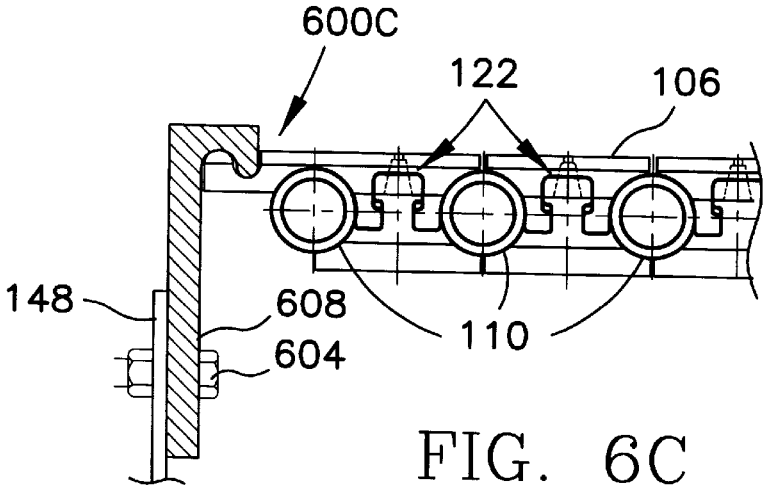

Referring to FIGS. 6A, 6B and 6C, all four walls of air plenum chamber 108 are directly attached to the grate surface 106 with all four walls to provide a tight air seal. In FIGS. 6A, 6B, and 6C, there are shown alternative sealing arrangements of the under grate air plenum chamber 108 to the grate surface 106 respectively generally designated by 600A, 600B and 600C of the water-cooled oscillating grate assembly 100. As shown in FIG. 6A, a sealing member 602 attached by a bolt 604 to the side walls 148 of air plenum unit 108, provides sealing to the grate surface 106 which reduces under grate air seal leakage rates. The result is improved air to fuel mixing and reduced maintenance requirements. In FIGS. 6B and 6C, a respective alternative sealing member 606 and 608 is attached by bolt 604 to the side walls 148 of air plenum unit 108, provides sealing to the grate surface 106.

Figure 7:
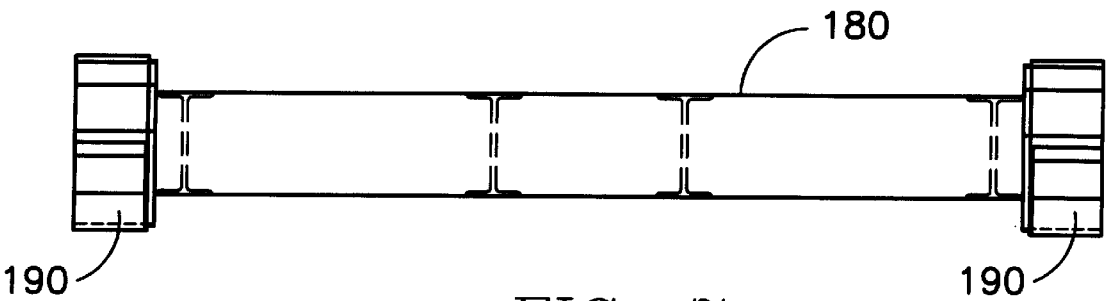
FIG. 7 is an end view of a pair of the preferred vibratory motors with shaft mounted, eccentric weights and the counter-balance of the water-cooled oscillating grate assembly of FIG. 1 in accordance with the present invention.

Referring now to FIGS. 1 and 7, the vibration drive isolation system or assembly 112 is arranged to minimize vibration to exterior plant equipment. Vibration drive isolation system 112 includes a longitudinal counterbalance member 180, a plurality of drive springs 182 supported by counterbalance member 180 and a plurality of isolation springs 182 supporting the counterbalance member 180. A structural steel base 188 supports the isolation springs 184 and is isolated from the boiler 102. The vibration unit has the following capabilities. Variable speed motor control capable for adjusting the vibration intensity. Control capability of ramping up and ramping down the vibration intensity during a timed cycle. The result is vibration system can easily be tuned and emissions can be controlled during a vibrating cycle.

At least one small variable speed drive motor 190, such as two or four horsepower motor(s), is included in assembly 112. The motor(s) 190, drive springs 182, and isolation springs 184 are mounted on the support steel under the grate unit 104 and are totally open and accessible even while the grate unit is in operation. An adjustable rate controller 192 operatively controls the variable speed drive motor(s) 190.

U.S. Pat. No. 3,251,457 entitled METHOD AND APPARATUS FOR DRIVING VIBRATORY DEVICES issued May 17, 1966 to George Dumbaugh, one of the present inventors, discloses a drive for vibratory devices where both frequency and stroke can be varied simultaneously. The subject matter of the above identified U.S. Pat. No. 3,251,457 is incorporated herein by reference.

Both the time between oscillations and the intensity of the oscillation can be controlled with an easy control panel adjustment of controller 192. They require no mechanical adjustment of eccentrics. Typically, oscillation cycles are approximately five minutes apart with oscillation five to ten seconds long. The times will vary depending on the fuel characteristics and the moisture content. Actual motion of grate unit 104 is about a quarter of an inch, and the entire grate surface 106 oscillates at once. Grate surface 106 do not have to be broken into separate oscillating zones. Variable oscillation control also allows the five to ten second oscillating cycles to start slowly and build up to full intensity.

The electric motors 191 of the vibratory drive assembly 112 are not attached to the grate unit as conventionally done. The dynamic counter-balance 180 is longitudinal and positioned under the combination of the steel coil drive springs 184 and multiple flat bar type of stabilizers 196. The assembly 112 is supported from the longitudinal counter-balance 180 by the appropriately spaced isolating springs 184 mounted in compression and appropriately spaced along its length. The vibratory motors with shaft mounted eccentric weights 190 are either installed on each side of the counter-balance 180 as shown in FIG. 7, or combined together, and placed underneath the counter-balance, or if one motor 190 is used, it is preferably put on top of the counter-balance 180 near the mid-point of the counter-balance 180.

The steel coil type drive springs 182 are distributed across the width and along the length of the underside of the enclosed vibrating grate unit 104. The drive springs 182 are combined with flat bar type stabilizers 194 to assure a uniform stroking action. The flat bar type stabilizers 194 are used to guide the movement of the stiff drive springs 182.

The drive springs 182 are sub-resonant tuned to cause them to inherently work harder under load, where sub means under and Resonant means natural frequency. Therefore, "Sub-resonant" means the maximum running speed of the vibratory motors 190 is always under the natural frequency of the combined drive springs. For example, if the top motor speed is 570 RPM, which in this instance is the same as CPM, then the natural frequency of all the drive springs 182 would be, for example, 620 CPM. While 570 CPM is preferred, other frequencies such as 720 CPM, 900 CPM or 1200 CPM, might be useful for various applications.

The axial centerline of the steel coil drive springs 182 is provided in line with the wanted stroke angle, but the axial centerline of the stabilizer 194 is perpendicular to the stroke angle. A stroke angle is illustrated with the plenum unit 108 in FIG. 1 and labeled STROKE ANGLE. By utilizing paralleled counter-balance or structural beams 180 as a longitudinal configuration, the enclosed vibrating grate unit 104 is dynamically counter-balanced. The structural Natural Frequency of the counter-balance assembly will be at least 1.4 times the maximum speed of the motors, but preferably will exceed it. In this instance, the RPM of the motor 190 is the same as the vibrating CPM of the enclosed grate unit 104.

Relatively soft steel coil type isolation springs 184 preferable are used to support the longitudinal counter-balance 180 which in turn supports the enclosed vibrating grate unit 104 above it. Preferable needed input power is proved by two, three phase, A-C squirrel cage vibratory motors 190 by either installing motors 190 on each side of the dynamic counter-balancing member 180 (FIG. 7).

Electrical adjustment of conveying speed is provided by the controller implements either as a variable voltage or an adjustable frequency type of electrical control. The conveying speed of the ash over the vibrating grate unit 104 can be electrically adjusted.

In operation, the vibratory motor(s) 190 are energized and the shaft mounted eccentric weights are accelerated to full speed. The force output of the rotating eccentric weights excites or induces all the stiff steel coil drive springs 182 and flat bar stabilizers 194 to vibrate back and forth in a straight line. The speed (RPM) of the vibratory motors 190 is the same as the vibrating frequency (CPM) of the drive springs 182. This happens even though the natural frequency of the drive springs 182 is above the motor speed. Consequently, the enclosed grate unit 104 vibrates at a prescribed amount of linear stroke at the wanted angle, which is usually 45°. As an equal reaction to the vibratory movement of enclosed grate unit 104, the counter-balance member 180 inherently moves in an opposite direction. Thus, the opposing dynamic forces cancel one another. The counter-balance 180 freely moves or floats on top the soft isolation springs 184 supporting it.

A resulting directional, straight line stroke on the enclosed grate unit 104 induces the ash particles to unidirectionally move forward simultaneously over the top grate surface 106 and the bottom surface 138 of air plenum 108. This ash movement is the result of a series of hops or pitches and catches by the applied vibration. Normally, the ash first settles on the grate. Then, it is gradually moved forward by repetitive on and off cycles of applied vibration. For example, the ash is moved 3 feet every 6 minutes. Alternatively, the ash movement over the grate surfaces could be electrically adjusted via adjustment of motor operation by controller 192 to provide, for example, a conveying speed of 0.5 FPM. The ash conveyed on the air permeated grate top 106 discharges into vertical chutes (not shown). The ash siftings that fall through any openings 120 in the grate surface 106 drop onto the bottom conveying pan 138 of the air plenum. When the vibratory conveying action is applied, these ash siftings move forward. Eventually, these particles fall down through outlets 140 located near the discharge end of the grate unit 104.

While the present invention has been described with reference to the details of the embodiments of the invention shown in the drawing, these details are not intended to limit the scope of the invention as claimed in the appended claims.

What is claimed is:

1. A water-cooled oscillating grate system for a boiler for use with biomass and other fuels comprising:

a grate unit having a top grate surface; said top grate surface including air-flow apertures;

a plurality of water-cooling pipes on which is supported said top grate surface; said plurality of water-cooling pipes adapted to be coupled to a water supply;

an air plenum unit positioned under and attached to said top grate surface; said air plenum unit adapted to be coupled to an air supply for providing combustion air through said top grate surface air-flow apertures; and a vibration drive isolation assembly associated with said grate unit for vibrating said grate unit and isolating said grate unit from said boiler.

2. The water-cooled oscillating grate system as recited in claim 1 wherein said grate unit is an enclosed, integral unit and includes a pair of water-cooling headers connecting said plurality of water-cooling pipes to said grate surface, said pair of water-cooling headers including a water-cooling inlet header and a water-cooling outlet header.

3. A water-cooled oscillating grate system as recited in claim 1 wherein said air plenum unit has multiple zones with each of said zones having an associated air flow control damper for controlling combustion air flow through said zone to said grate surface.

4. A water-cooled oscillating grate system as recited in claim 3 wherein said air plenum unit includes a collecting and conveying bottom for receiving ash siftings and said air plenum unit includes at least one ash-siftings discharge opening.

5. A water-cooled oscillating grate system as recited in claim 4 wherein said at least one ash-siftings discharge opening is located at a defined discharge end of said air plenum unit; said ash siftings being directionally and simultaneously vibrated by said vibration isolation assembly to said ash-siftings discharge openings.

6. A water-cooled oscillating grate system as recited in claim 1 wherein said top grate surface is disposed generally horizontally and wherein said vibration drive isolation assembly includes a stroke angle of at least 20 degrees from the horizontal.

7. A water-cooled oscillating grate system as recited in claim 1 wherein said vibration drive isolation assembly has a set operating frequency, and said vibration drive isolation assembly having a stroke for developing a unidirectional conveying action for directionally vibrating ash siftings to multiple ash-siftings discharge openings located at a defined discharge end of said air plenum unit.

8. A water-cooled oscillating grate system as recited in claim 7 wherein said set operating frequency is at least 570 cycles per minute (CPM) and wherein said stroke for developing said unidirectional conveying action is of at least 1.0 G.

9. A water-cooled oscillating grate system as recited in claim 1 wherein said vibration drive isolation assembly is positioned under said grate unit.

10. A water-cooled oscillating grate system as recited in claim 1 wherein said vibration drive isolation assembly includes a plurality of drive springs; said drive springs being distributed across at least the width of said grate unit.

11. A water-cooled oscillating grate system as recited in claim 10 wherein said vibration drive isolation assembly includes a longitudinal counterbalance member.

12. A water-cooled oscillating grate system as recited in claim 11 wherein said vibration drive isolation assembly includes a plurality of isolation springs supporting said longitudinal counterbalance member.

13. A water-cooled oscillating grate system as recited in claim 12 wherein said isolations springs and said drive springs are steel coil springs; said drive springs being stiffer than said isolation springs.

14. A water-cooled oscillating grate system as recited in claim 12 wherein said vibration drive isolation assembly includes a pair of three phase, A-C squirrel cage vibratory motors installed on said longitudinal counterbalance member.

15. A water-cooled oscillating grate system as recited in claim 12 wherein said vibration drive isolation assembly includes at least one electrical vibratory drive motor.

16. A water-cooled oscillating grate system as recited in claim 15 wherein said vibration drive isolation assembly includes a variable speed motor controller for adjusting vibration intensity.

17. A water-cooled oscillating grate system as recited in claim 16 wherein said variable speed motor controller being operatively arranged for dynamically adjusting vibration intensity during a timed cycle.

18. A water-cooled oscillating grate system as recited in claim 16 wherein said variable speed motor controller includes a variable voltage motor controller.

19. A water-cooled oscillating grate system as recited in claim 16 wherein said variable speed motor controller includes a variable frequency motor controller.

20. A water-cooled oscillating grate system as recited in claim 1, wherein said vibration drive isolation assembly produces a vibratory stroke having a direction; and further includes a flexible labyrinth seal between said grate unit and the boiler; said flexible labyrinth seal being a blade and said blade being aligned with the direction of the vibratory stroke.

21. A water-cooled oscillating grate system as recited in claim 1 includes a flexible seal between an air supply port for said air supply coupled to said air plenum unit and includes a flexible seal between an inlet and outlet water supply ports for said water supply coupled to said water-cooling pipes.

22. A water-cooled, vibrating grate system for a boiler for use with biomass and other fuels comprising:

a water-cooled grate unit having a top grate surface including air-flow apertures and an air plenum unit positioned under and attached to said top grate surface; said air plenum unit adapted to be coupled to an air supply for providing combustion air through said top grate surface air-flow apertures; and a vibration drive isolation assembly for vibrating said grate unit; said vibration drive isolation assembly including a longitudinally extending counterbalance member; a plurality of drive springs supported by said counterbalance member with said drive springs being distributed across at least the width of said grate unit; at least one vibratory drive motor installed on said counterbalance member; and a plurality of isolation springs supporting said longitudinal counterbalance member.

23. A water-cooled oscillating grate system as recited in claim 22 wherein said air plenum unit includes multiple zones; each zone having an associated air flow control damper for controllably providing combustion air flow.

24. A water-cooled oscillating grate system as recited in claim 22 wherein said air plenum unit includes multiple ash-siftings discharge openings located at a defined discharge end of said air plenum unit; said ash siftings being directionally and simultaneously vibrated to said ash-siftings discharge openings by said vibration drive isolation assembly.

25. A water-cooled oscillating grate system as recited in claim 22 wherein said vibration drive isolation assembly includes a variable speed motor controller for adjusting vibration intensity.

26. A water-cooled oscillating grate system as recited in claim 22 wherein said vibration drive isolation assembly has a set operating frequency; and said vibration drive isolation assembly having a linear stroke for developing a unidirectional conveying action for directionally vibrating ash siftings to multiple ash-siftings discharge openings located at a defined discharge end of said air plenum unit.

27. A water-cooled oscillating grate system as recited in claim 22 wherein said vibration drive isolation assembly has a defined stroke angle and includes drive springs that are in alignment with said stroke angle.

28. A water-cooled oscillating grate system as recited in claim 22 wherein said water-cooled grate unit includes a plurality of water-cooling pipes supporting said top grate surface and includes a water-cooling inlet header supplying cooling water to said plurality of water-cooling pipes and a water-cooling outlet header receiving cooling water from said plurality of water-cooling pipes.

* * * * *